US008921775B2

(12) United States Patent
Langridge et al.

(10) Patent No.: US 8,921,775 B2
(45) Date of Patent: Dec. 30, 2014

(54) ELECTROSTATIC GIMBAL FOR CORRECTION OF ERRORS IN TIME OF FLIGHT MASS SPECTROMETERS

(75) Inventors: David J. Langridge, Stockport (GB); Jason Lee Wildgoose, Stockport (GB); John Brian Hoyes, Stockport (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 14/004,946

(22) PCT Filed: Mar. 13, 2012

(86) PCT No.: PCT/GB2012/050549

§ 371 (c)(1), (2), (4) Date: Oct. 29, 2013

(87) PCT Pub. No.: WO2012/123733

PCT Pub. Date: Sep. 20, 2012

(65) Prior Publication Data

US 2014/0054454 A1 Feb. 27, 2014

Related U.S. Application Data

(60) Provisional application No. 61/476,856, filed on Apr. 19, 2011.

(30) Foreign Application Priority Data

Mar. 15, 2011 (GB) ..... 1104310.6

(51) Int. Cl.
*H01J 49/00* (2006.01)
*H01J 49/40* (2006.01)

(52) U.S. Cl.
CPC ..... *H01J 49/403* (2013.01); *H01J 49/40* (2013.01)
USPC ..... 250/287; 250/281; 250/282; 250/286

(58) Field of Classification Search
CPC ..... H01J 49/40; H01J 49/061; H01J 49/06; H01J 49/02; H01J 2237/304; H01J 37/05
USPC ..... 250/281, 282, 283, 286, 287, 288, 290, 250/294
See application file for complete search history.

(56) References Cited

U.S. PATENT DOCUMENTS

| | | | | |
|---|---|---|---|---|
| 5,654,544 | A | 8/1997 | Dresch | |
| 5,864,137 | A | 1/1999 | Becker et al. | |
| 5,910,656 | A | 6/1999 | Koster et al. | |
| 6,849,846 | B2 | 2/2005 | Bertsch | |
| 7,932,491 | B2 | 4/2011 | Vestal | |
| 2007/0176090 | A1 * | 8/2007 | Verentchikov | 250/287 |

FOREIGN PATENT DOCUMENTS

| | | |
|---|---|---|
| JP | 2002260574 | 9/2002 |
| WO | 03058673 | 7/2003 |

OTHER PUBLICATIONS

Wiley et al., "*Time-of-Flight Mass Spectrometer With Improved Resolution*" The Review of Scientific Instruments, vol. 26, No. 12, pp. 1150-1157, 1955.

* cited by examiner

*Primary Examiner* — Nicole Ippolito
*Assistant Examiner* — Hanway Chang
(74) *Attorney, Agent, or Firm* — Diederiks & Whitelaw, PLC

(57) ABSTRACT

A Time of Flight mass analyser is disclosed comprising one or more devices arranged and adapted to correct for tilt in an isochronous plane of ions and to adjust the isochronous plane of the ions so as to be parallel with the plane of detection in an ion detector.

14 Claims, 11 Drawing Sheets

ELECTROSTATIC GIMBAL FOR CORRECTION OF ERRORS IN TIME OF FLIGHT MASS SPECTROMETERS

CROSS-REFERENCE TO RELATED APPLICATIONS

This application is the National Stage of International Application No. PCT/GB2012/050549, filed 13 Mar. 2012, which claims priority from and the benefit of U.S. Provisional Patent Application Ser. No. 61/476,856 filed on 19 Apr. 2011 and United Kingdom Patent Application No. 1104310.6 filed on 15 Mar. 2011. The entire contents of these applications are incorporated herein by reference.

BACKGROUND TO THE PRESENT INVENTION

The present invention relates to a Time of Flight mass analyser and a method of analysing ions. It is well known to those skilled in the art of Time of Flight mass spectrometer design that one of the factors that limit the resolution of Time of Flight mass spectrometers is the optical alignment between the various components that comprise the mass spectrometer. This is especially important in orthogonal acceleration Time of Flight ("oa-TOF") mass spectrometers which commonly comprise a set of parallel electric field regions which are delineated by a series of meshes or grids with precise mechanical separation. The location of these optical components are known as the principle planes of the Time of Flight mass spectrometer. Particular attention is paid to the parallelism and flatness of the principle planes which are commonly aligned to within a few microns to enable high mass resolution.

Misalignment of any of the principle planes of an orthogonal acceleration Time of Flight mass analyser such as the pusher electrode, first and second grid electrodes and the ion detector can result in a significantly reduced resolution.

It is desired to provide an improved Time of Flight mass analyser and method of mass analysing ions.

SUMMARY OF THE INVENTION

According to an aspect of the present invention there is provided a Time of Flight mass analyser comprising:

one or more devices arranged and adapted to correct for tilt in one or more isochronous planes of ions.

The one or more isochronous planes of ions preferably comprise ions having a particular mass to charge ratio. The one or more devices preferably correct for tilt in the isochronous plane of substantially all ions having a wide range of mass to charge ratios which are desired to be detected by an ion detector forming part of the Time of Flight mass analyser. The one or more devices according to the preferred embodiment preferably correct simultaneously for all ions of all mass to charge ratios seen by the spectrometer since the one or more devices preferably correct for a mechanical misalignment which is effectively experienced by all ions of different mass to charge ratios. The apparatus and method according to the preferred embodiment are preferably arranged to correct for misalignment between an isochronous plane of ions (or the isochronous planes of ions) resulting from the ion-optical components of the Time of Flight mass analyser and an isochronous or detector plane of an ion detector. The apparatus and method according to the preferred embodiment preferably adjusts, tilts or corrects an isochronous plane (or the isochronous planes) of the ions so that the isochronous plane is brought back into alignment with the detector plane of the ion detector i.e. so that the isochronous plane of ions is made substantially parallel with the detector plane of the ion detector.

The Time of Flight mass analyser preferably further comprising an ion detector.

According to a less preferred embodiment the Time of Flight mass analyser may comprise an axial acceleration Time of Flight mass analyser.

According to a preferred embodiment the Time of Flight mass analyser comprises an orthogonal acceleration Time of Flight mass analyser.

The Time of Flight mass analyser preferably further comprises an orthogonal acceleration region. The orthogonal acceleration region preferably comprises a pusher or puller electrode and/or a first grid or other electrode and/or a second grid or other electrode.

The Time of Flight mass analyser preferably further comprises a first field free region between the pusher or puller electrode and the first grid or other electrode.

The Time of Flight mass analyser preferably further comprises a second field free region between the first grid or other electrode and the second grid or other electrode.

The Time of Flight mass analyser preferably further comprises a third field free region located either: (i) between the orthogonal acceleration region and the ion detector; or (ii) between the second grid or other electrode and the ion detector.

The one or more devices are preferably arranged and adapted to correct for tilt in one or more isochronous planes of ions preferably having particular mass to charge ratios so that the one or more isochronous planes are aligned so as to be substantially parallel to a plane of ion detection located upon a surface of or within the ion detector.

The one or more isochronous planes preferably comprise the plane of best fit of ions (preferably having a particular mass to charge ratio) at a particular point in time.

The one or more devices may comprise one or more mechanical devices for mechanically correcting for the tilt.

The one or more devices may comprise one or more electrostatic devices for electrostatically correcting for the tilt.

According to the preferred embodiment the one or more devices comprise a first acceleration stage and/or a first deceleration stage.

The first acceleration stage and/or the first deceleration stage are preferably arranged and adapted to act upon an ion beam passing through the first acceleration stage and/or the first deceleration stage in a manner such that the time of flight or time of flight characteristics of ions in the ion beam are varied non-uniformly in a first transverse direction across the ion beam.

The first acceleration stage and/or the first deceleration stage are preferably arranged and adapted to correct for tilt in a first direction.

The first acceleration stage and/or the first deceleration stage may be located either: (i) upstream of, downstream of or at intermediate position along the first field free region; (ii) upstream of, downstream of or at intermediate position along the second field free region; (iii) upstream of, downstream of or at intermediate position along the third field free region; or (iv) upstream of, downstream of or at intermediate position along a field free region.

The first acceleration stage and/or the first deceleration stage may comprise a third grid or other electrode and a fourth grid or other electrode, wherein the third grid or other electrode is inclined at an angle $\alpha$ to the fourth grid or other electrode and wherein $\alpha \neq 0$. Preferably, $\alpha$ is selected from the group consisting of: (i) <5°; (ii) 5-10°; (iii) 10-15°; (iv)

15-20°; (v) 20-25°; (vi) 25-30°; (vii) 30-35°; (viii) 35-40°; (ix) 40-45°; (x) 45-50°; (xi) 50-55°; (xii) 55-60°; (xiii) 60-65°; (xiv) 65-70°; (xv) 70-75°; (xvi) 75-80°; (xvii) 80-85°; and (xviii) >85°.

According to an embodiment the one or more devices may further comprise a second acceleration stage and/or a second deceleration stage.

The second acceleration stage and/or the second deceleration stage are preferably arranged and adapted to act upon an ion beam passing through the second acceleration stage and/or the second deceleration stage in a manner such that the time of flight or time of flight characteristics of ions in the ion beam are varied non-uniformly in a second transverse direction across the ion beam.

According to the preferred embodiment the second transverse direction is substantially orthogonal to the first transverse direction.

The second acceleration stage and/or the second deceleration stage are preferably arranged and adapted to correct for tilt in a second direction.

According to the preferred embodiment the second direction is substantially orthogonal to the first direction.

The second acceleration stage and/or the second deceleration stage is preferably located either: (i) upstream of, downstream of or at intermediate position along the first field free region; (ii) upstream of, downstream of or at intermediate position along the second field free region; (iii) upstream of, downstream of or at intermediate position along the third field free region; or (iv) upstream of, downstream of or at intermediate position along a field free region.

The second acceleration stage and/or the second deceleration stage preferably comprises a fifth grid or other electrode and a sixth grid or other electrode, wherein the fifth grid or other electrode is inclined at an angle $\mu$ to the sixth grid or other electrode and wherein $\beta \neq 0$. Preferably, $\beta$ is selected from the group consisting of: (i) <5°; (ii) 5-10°; (iii) 10-15°; (iv) 15-20°; (v) 20-25°; (vi) 25-30°; (vii) 30-35°; (viii) 35-40°; (ix) 40-45°; (x) 45-50°; (xi) 50-55°; (xii) 55-60°; (xiii) 60-65°; (xiv) 65-70°; (xv) 70-75°; (xvi) 75-80°; (xvii) 80-85°; and (xviii) >85°.

The tilt in the one or more isochronous planes preferably results from misalignment of one or more ion-optical components.

The Time of Flight mass analyser preferably further comprises a device arranged upstream of the orthogonal acceleration region and adapted to introduce a first order spatial focusing term in order to improve spatial focusing of a beam of ions.

The Time of Flight mass analyser preferably further comprises a beam expander arranged upstream of the orthogonal acceleration region, the beam expander being arranged and adapted to reduce an initial spread of velocities of ions arriving at the orthogonal acceleration region.

According to an embodiment one or more acceleration or deceleration stages are provided downstream of the one or more devices.

The one or more acceleration or deceleration stages are preferably arranged and adapted to alter the kinetic energy of the ions so that ions emerging from the one or more acceleration or deceleration stages have substantially the same kinetic energy as they had immediately prior to passing through the one or more devices.

According to another aspect of the present invention there is provided a mass spectrometer comprising at Time of Flight mass analyser as described above.

According to another aspect of the present invention there is provided a method of mass analysing ions comprising:

providing a Time of Flight mass analyser; and correcting for tilt in one or more isochronous planes of ions.

The method may further comprise electrostatically correcting for tilt in the isochronous plane of ions.

The method may further comprise mechanically correcting for tilt in the isochronous plane of ions.

According to another aspect of the present invention there is provided a mass spectrometer comprising:

an orthogonal acceleration region wherein, in use, a packet of ions is orthogonally accelerated into a time of flight region;

two inclined electrodes or grids located in the time of flight region; and a device arranged and adapted to apply voltages to the electrodes so as to provide a first order correction for tilt in the isochronous plane of ions having a particular mass to charge ratio and which pass, in use, through the time of flight region.

According to an aspect of the present invention there is provided an apparatus and a method to correct for alignment errors in the optical components of Time of Flight mass spectrometers by introduction of one or more supplementary acceleration or deceleration stages whose properties vary transversely across the ion beam.

According to an aspect of the present invention there is provided a Time of Flight mass analyser comprising:

one or more devices arranged and adapted to correct for tilt in an isochronous plane of ions having a particular mass to charge ratio.

The one or more devices preferably realign the isochronous plane of ion so as to be substantially parallel with a detector plane of an ion detector.

According to another aspect of the present invention there is provided a method of mass analysing ions comprising:

providing a Time of Flight mass analyser; and correcting for tilt in an isochronous plane of ions having a particular mass to charge ratio.

The method preferably comprises realigning the isochronous plane of ions so as to be substantially parallel with a detector plane of an ion detector.

The preferred embodiment relates to an improvement to existing apparatus, specifically Time of Flight mass analysers. The preferred embodiment corrects for errors in mechanical alignment of the optical components that make up a Time of Flight instrument or a Time of Flight mass analyser or mass spectrometer.

The preferred embodiment may compensate for mechanical misalignments in the ion optical components in a Time of Flight mass analyser by introducing a small acceleration or deceleration region. The Time of Flight characteristics preferably vary transversely across the extent of the ion beam and preferably exactly counteract the Time of Flight errors caused by component misalignment.

The preferred embodiment can allow for a relaxing of parallelism tolerances in the construction of a Time of Flight instrument. The misalignments can be tuned out electrically to bring the instrument back into focus. The potential cost savings for reduced tolerance build analysers are considerable.

The preferred embodiment solves the problem of imperfect alignment of Time of Flight components.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; and (xx) a Glow Discharge ("GD") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) one or more energy analysers or electrostatic energy analysers; and/or (h) one or more ion detectors; and/or (i) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wein filter; and/or (j) a device or ion gate for pulsing ions; and/or (k) a device for converting a substantially continuous ion beam into a pulsed ion beam.

The mass spectrometer may further comprise a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

BRIEF DESCRIPTION OF THE DRAWINGS

Various embodiments of the present invention will now be described, by way of example only, and with reference to the accompanying drawings in which.

DETAILED DESCRIPTION OF THE PREFERRED EMBODIMENTS

Figure 1A:
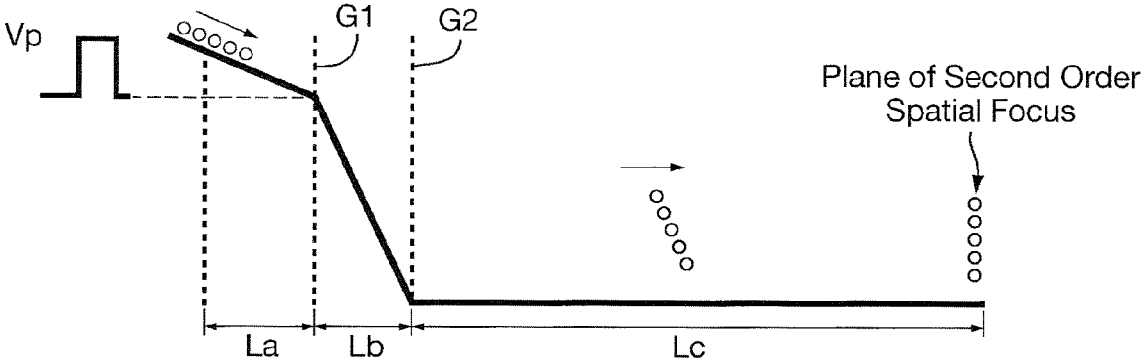
FIG. 1A shows space focusing in a linear Time of Flight mass spectrometer and FIG. 1B shows space focusing in a reflectron Time of Flight mass spectrometer.
Figure 1B:
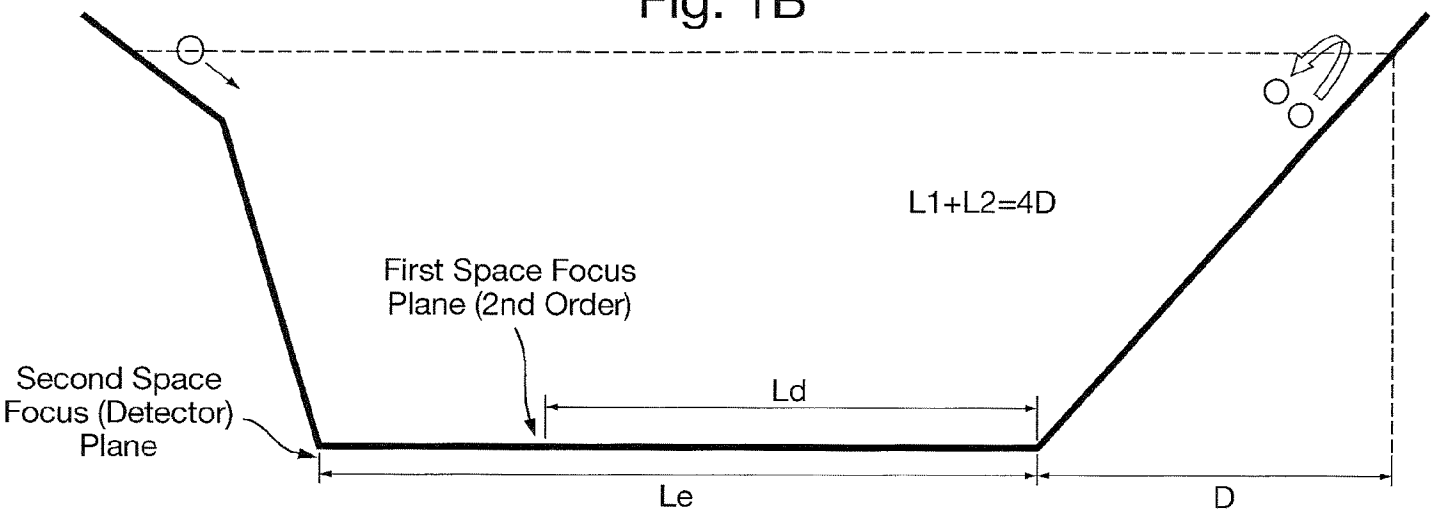

Wiley and McLaren (Time-of-Flight Mass Spectrometer with Improved Resolution, Rev. Sci. Instrum. 26, 1150 (1955)) set out the mathematical formalism upon which subsequent Time of Flight instruments have been designed. The concept of compacting an initial positional distribution of ions by combination of acceleration and drift regions is known as spatial focusing. By using two distinct electric field regions, (the first of which is pulsed to an accelerating potential Vp) followed by a drift tube (held at Vtof), the initial ion beam is compacted to a narrower spatial distribution in the axial z direction at the plane of the ion detector as shown in the potential energy diagram of FIG. 1A. The ratio of the magnitudes and distances of the two electric fields and the field free drift length are set precisely in accordance with the principle of spatial focusing set out in the Wiley McLaren paper. It is also known that the addition of a reflectron (see FIG. 1B) can provide for spatial focusing in a folded geometry instrument that provides for longer flight times and higher resolution. The following description of the preferred embodiment is equally applicable to both linear and reflectron based geometries.

Figure 2:
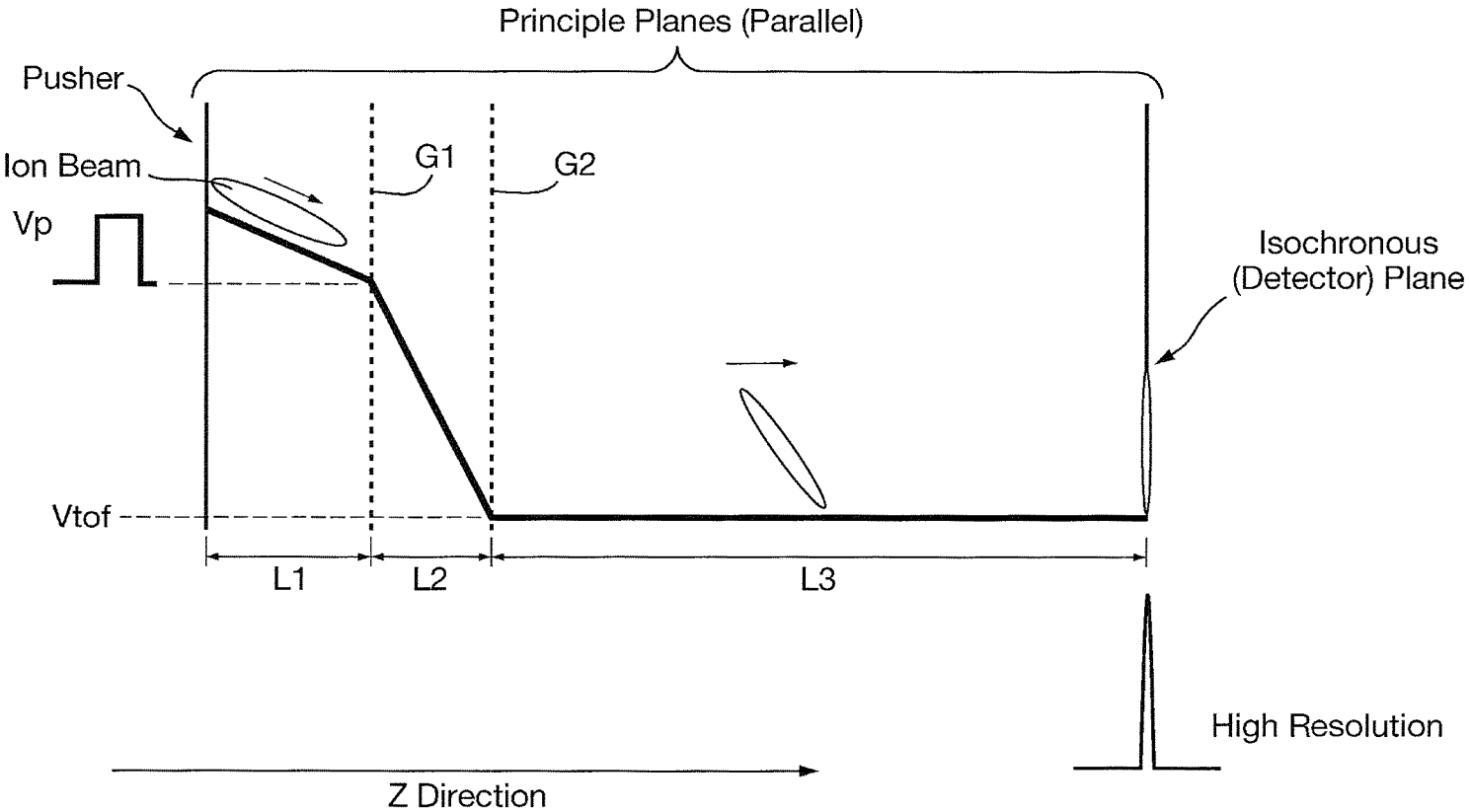
FIG. 2 shows principle planes of a two stage Wiley McLaren orthogonal acceleration Time of Flight mass spectrometer.

In the simpler two stage geometry of FIG. 2 the principle planes which define the instrument geometry are the pusher electrode, two grid electrodes G1,G2 and the ion detector. For highest mass resolution these principle planes should be as flat and parallel as possible. Indeed modern instruments employing reflectrons which achieve resolutions of 50,000 or more require overall parallelism of better than 10 microns throughout the instrument and across the entire transverse beam trajectory. Such a high degree of tolerance requires very precise machining over large distances and is therefore expensive and difficult to achieve consistently.

Figure 3:
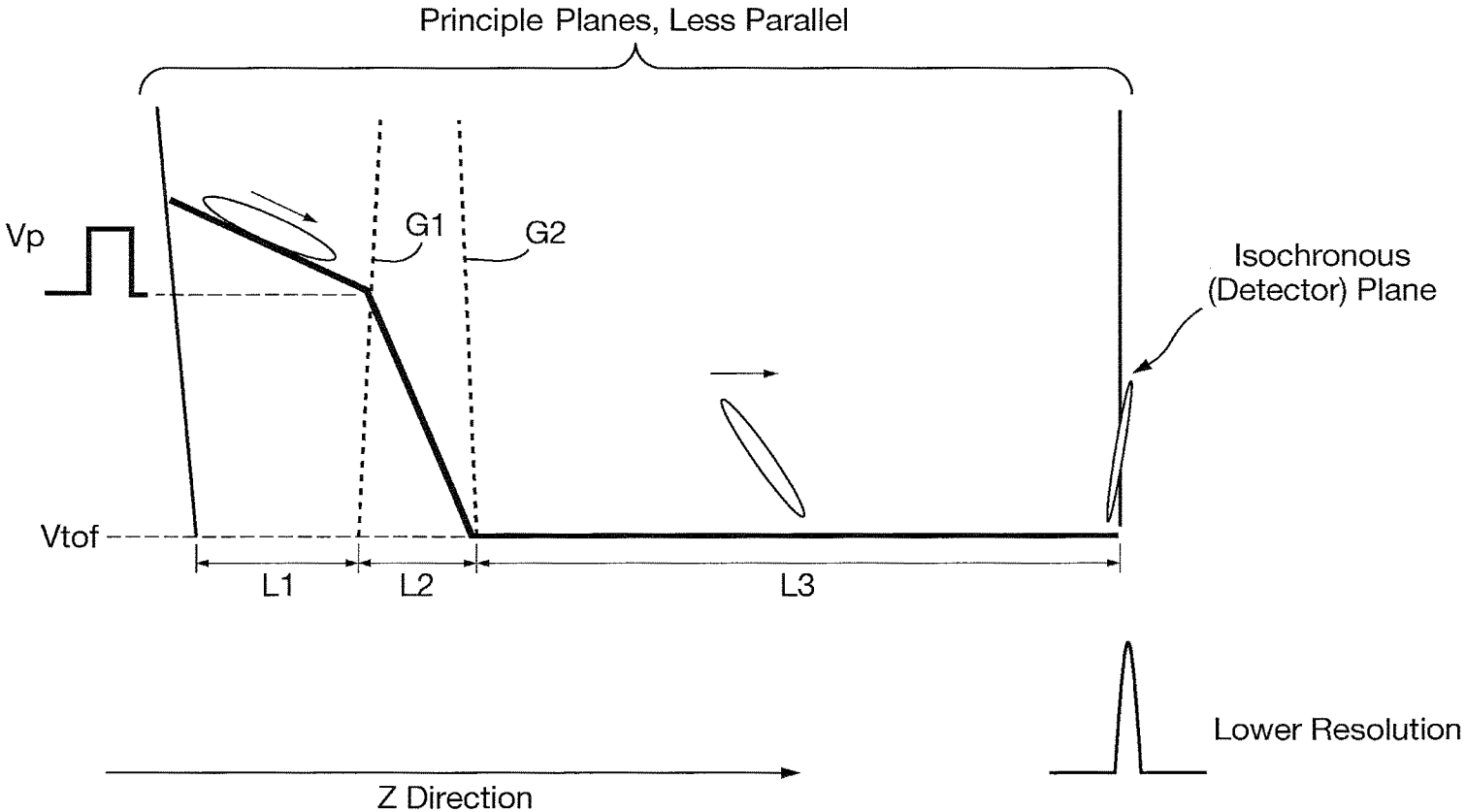
FIG. 3 shows principle planes of a two stage orthogonal acceleration Time of Flight mass spectrometer which are non-parallel.

FIG. 3 shows how misaligned principle planes lead to a distortion in the isochronous plane at the ion detector thus degrading instrumental resolution. Unless the magnitude and direction of the misalignments of each of the principle planes is known precisely their quantitative cumulative effect on Time of Flight resolution cannot be predicted. It is known to those skilled in the art that small variations in the axial or z position of the principle planes can be corrected by small changes in the applied voltage that create the electric fields. This is because the solutions for spatial focusing do not depend upon exact distances, but rather a combination of distance and fields so a change in one can compensate for an error in the other. However, in the transverse x and y directions no such degree of freedom exists and computer modeling reveals that a convolution of a multiplicity of such small tilts in the x and y directions of the principle planes leads to an overall tilt in the isochronous plane at the ion detector.

The preferred embodiment relates to an electrostatic method to compensate for these misalignments. The preferred embodiment has the benefit of optimizing the resolution of a spectrometer while relaxing the tolerances required for the positioning of the components at the principle planes while requiring no moving parts.

Figure 4:
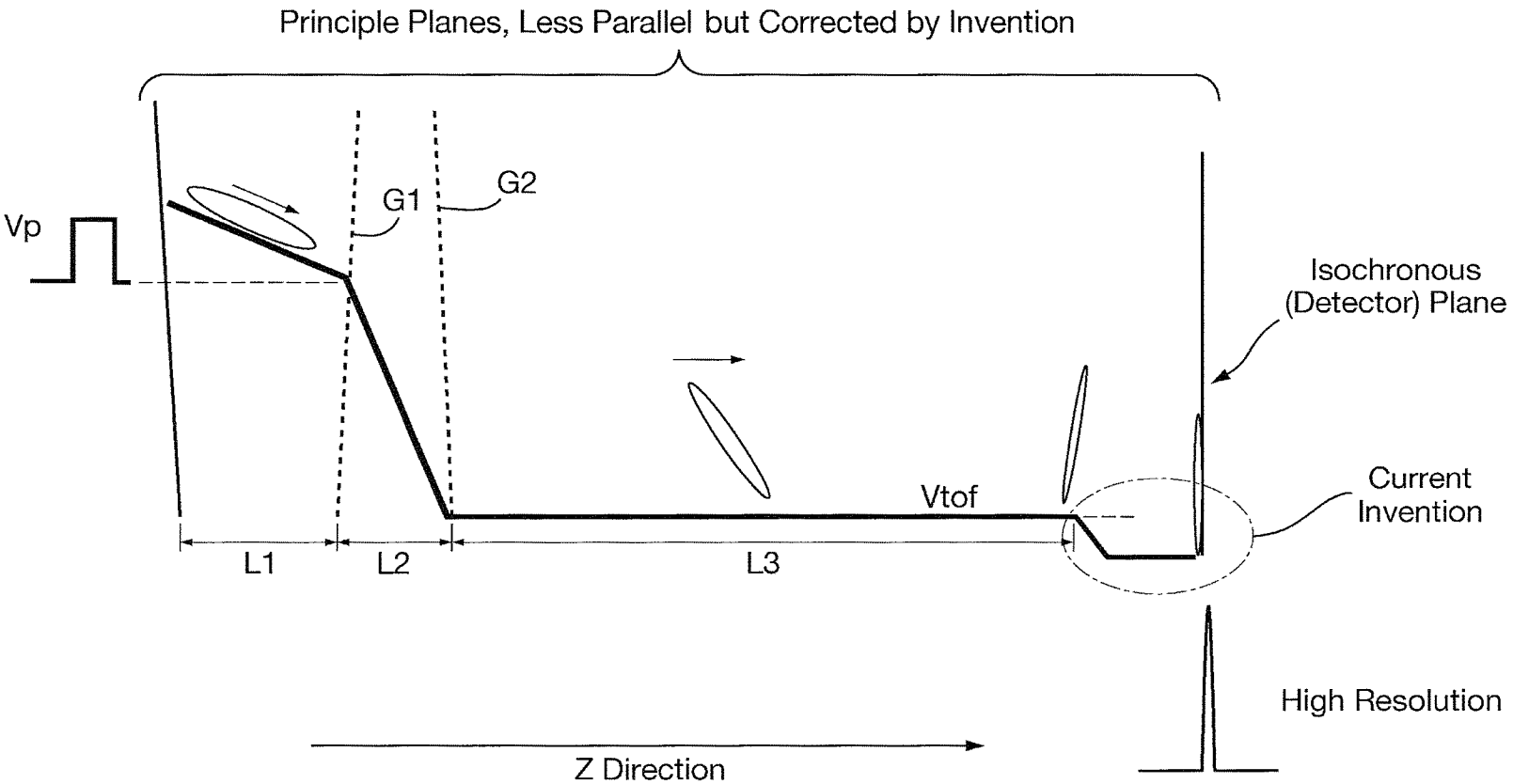
FIG. 4 shows an embodiment of the present invention wherein a supplementary acceleration stage is provided upstream of an ion detector.

FIG. 4 shows an embodiment of the invention wherein a small supplementary acceleration stage is placed in the field free region before the ion detector. By adjusting the voltage on the supplementary stage it is possible to correct for the tilt in the isochronous plane caused by the previously described misalignments.

Figure 5:
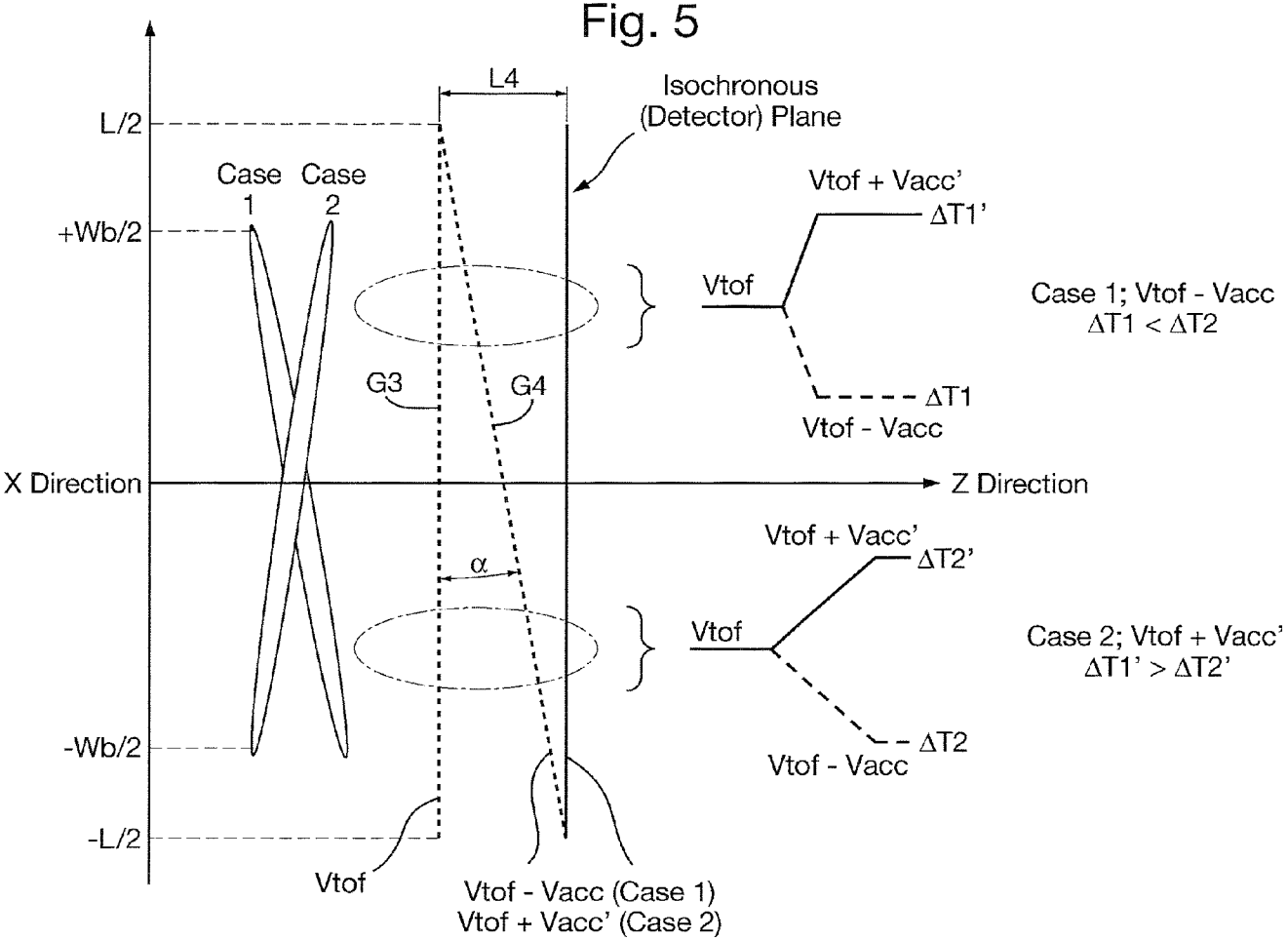
FIG. 5 shows a preferred embodiment of the present invention.

The theory of operation of the preferred device is best understood with reference to FIG. 5. Ions have a kinetic energy defined by the overall acceleration potential of the analyser geometry and traverse the field free region held at potential Vtof. The ions then enter the preferred device which preferably consists of two grids G3, G4 situated in the field free region. The first grid G3 is placed essentially parallel to the principle planes of the instrument and the fourth grid G4 is inclined at an angle a to the principle plane. The first grid G3 is held at the same potential as the flight tube whereas the second grid G4 is held at the ion detector potential which may be varied with respect to Vtof. The nature of the tilt of the incoming ion beam (Case1) may be considered whereby the portion of the ion beam with positive x values is lagging behind that with negative x values. According to the preferred embodiment the voltage is lowered on the second grid G4 and the detector by a value Vacc to give a net post acceleration. The additional time of flight of the ions in the beam with positive x values, ΔT1, is then less than that of negative x values, ΔT2. By adjusting the magnitude of Vacc accordingly it is possible to exactly counteract the tilt caused by misalignment and so bring the beam back into time focus thus optimizing the resolution of the spectrometer. It is not always possible to know or predict the sense of the tilt in the isochronous plane and hence the preferred embodiment is preferably able to correct for both senses. Conversely, considering Case 2 it can been seen that by reversing the polarity to give a net post deceleration that the additional time of flight for ions of positive x value ΔT1' is longer than that for negative x values ΔT2'. Again Vacc' can be adjusted to bring the beam back into time focus and optimize spectrometer resolution. It should also be understood that the time correction provided by the preferred embodiment is linear in x as shown in FIG. 4 and that the distortion caused by the misalignment in the components at the principle planes is also transversely linear in nature.

Figure 6:
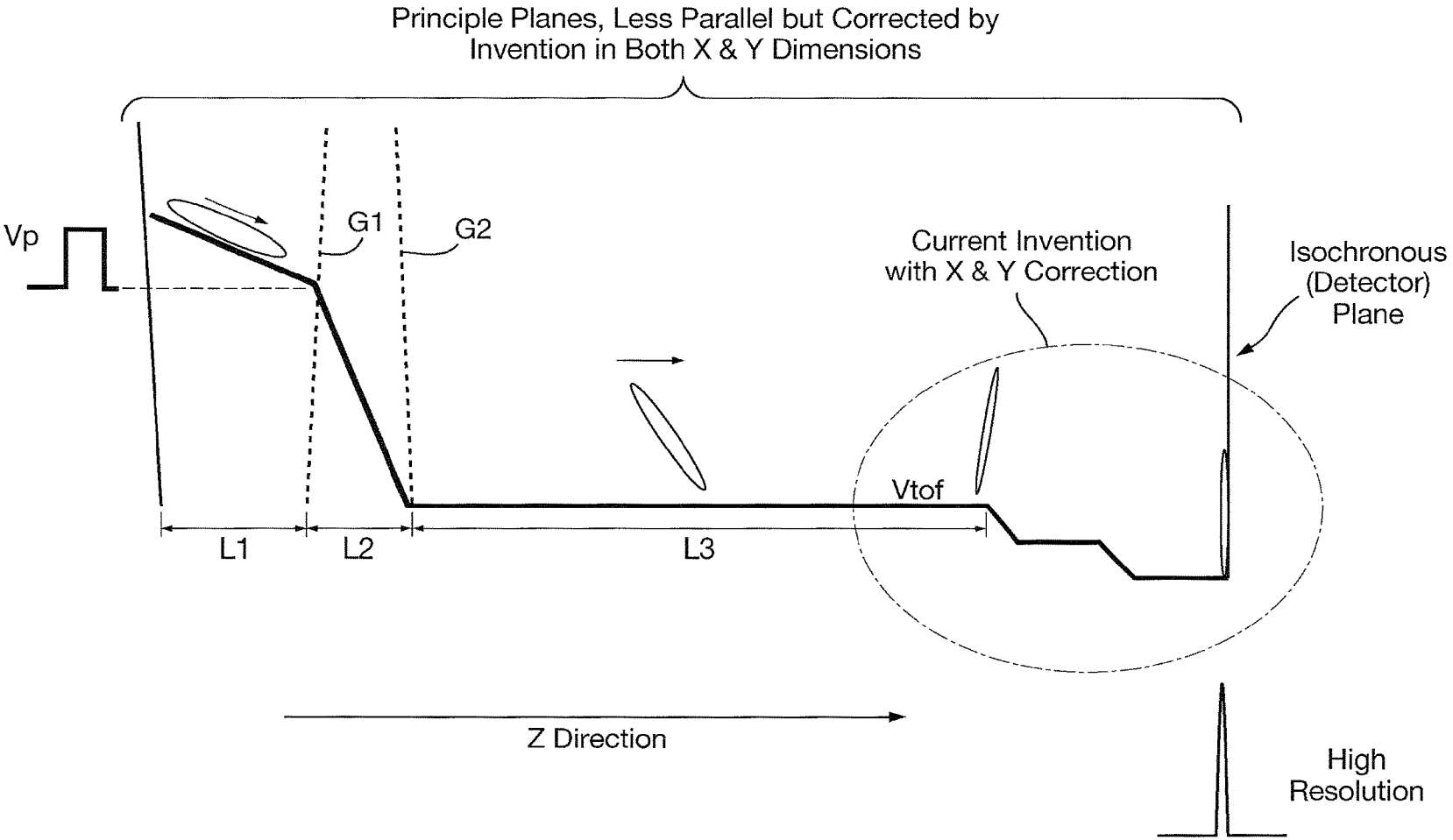
FIG. 6 shows a preferred embodiment of the present invention wherein two acceleration stages are provided.

The device shown in FIG. 5 is only able to correct for errors in a single dimension—in this case a correction in the x direction. In order to correct for errors in the y dimension it is necessary to cascade another device with or after the first device. Such a scheme is shown in FIG. 6.

Figure 7A:
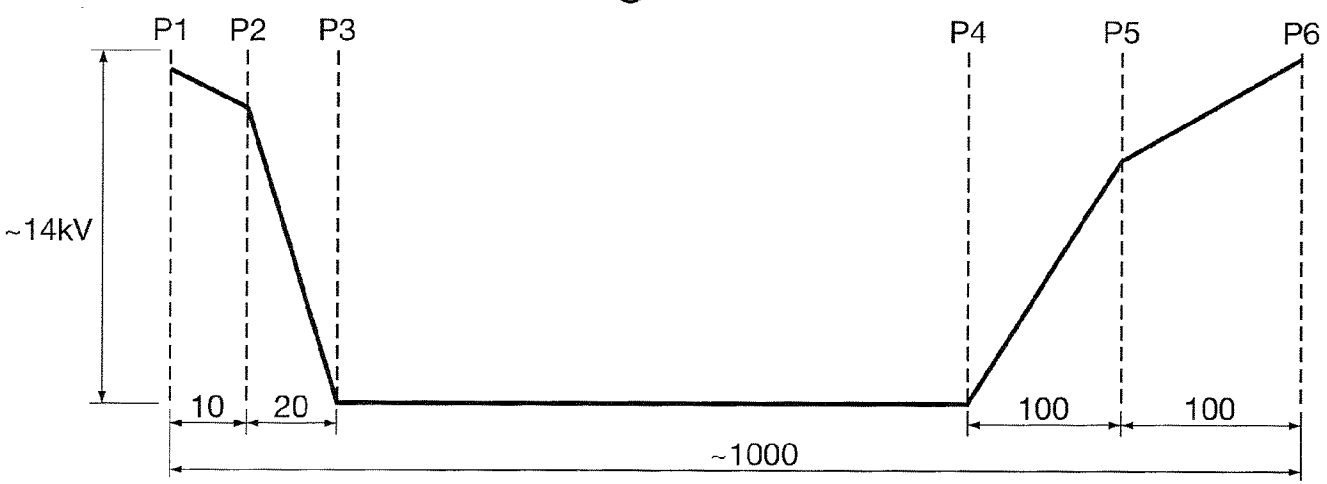
FIG. 7A shows a potential energy diagram of typical high performance orthogonal acceleration Time of Flight mass analyser and FIG. 7B shows grid electrodes according to a preferred embodiment
Figure 7B:
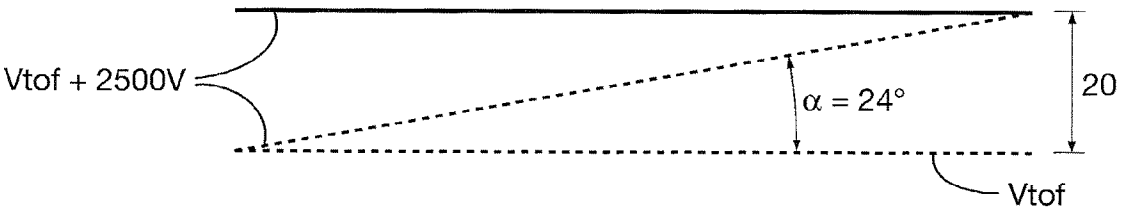

The typical geometrical parameters for a high resolution commercial orthogonal acceleration Time of Flight instrument are shown in FIG. 7A. Such an instrument is capable with a flight path of about 1 m and ion energy of 14 keV of a mass resolution of 25,000 Full Width Half Maximum (FWHM). If the beam width Wb (see FIG. 5) is 20 mm and an angular tilt of 1 degree is imposed in one dimension at principle plane P3, then the resolution degrades to 8500 FWHM. FIG. 7B shows the geometry and voltage applied to two grid electrodes according to an embodiment of the present invention that may be used to correct for the misalignment and restore the resolution back to 25,000 FWHM.

Various alternative embodiments are contemplated. According to an embodiment the transversely varying optical element may comprise an electrode rather than a grid i.e. the preferred embodiment may be gridless in its construction.

The preferred embodiment is also applicable to other Time of Flight instruments such as axial MALDI systems. It is also applicable to gridless Time of Flight spectrometers and itself may be gridless.

Simulations

Various simulations were performed based upon a Waters (RTM) Vmode G2 Time of Flight mass spectrometer. Simulations were performed on the basis of a 3 mm tophat positional spread of ions, 10/40 gausslinear velocity, 70 eV in source axis (1 eV standard deviation), 30 mm beam width in pusher and grid scattering enabled.

Figure 8:
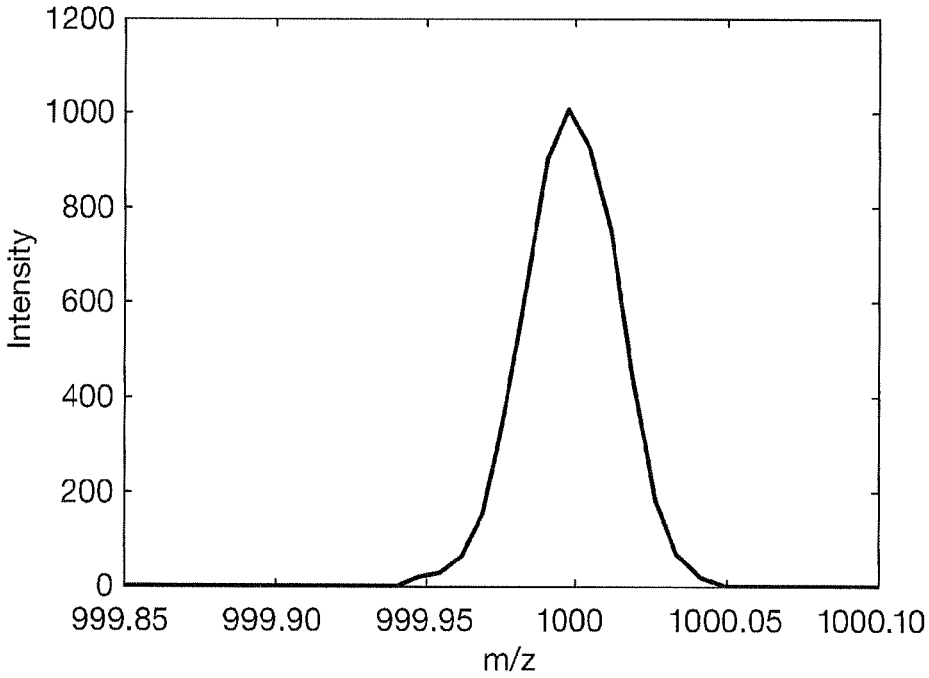
FIG. 8 shows a base system mass peak with a resolution of 27 k.

For a base system peak (i.e. all grids are flat and wherein no correction grid according to the preferred embodiment is utilised) a resolution of about 27 k was observed as shown in FIG. 8. The voltage on the acceleration stage (P2) was 9585 V.

Figure 9:
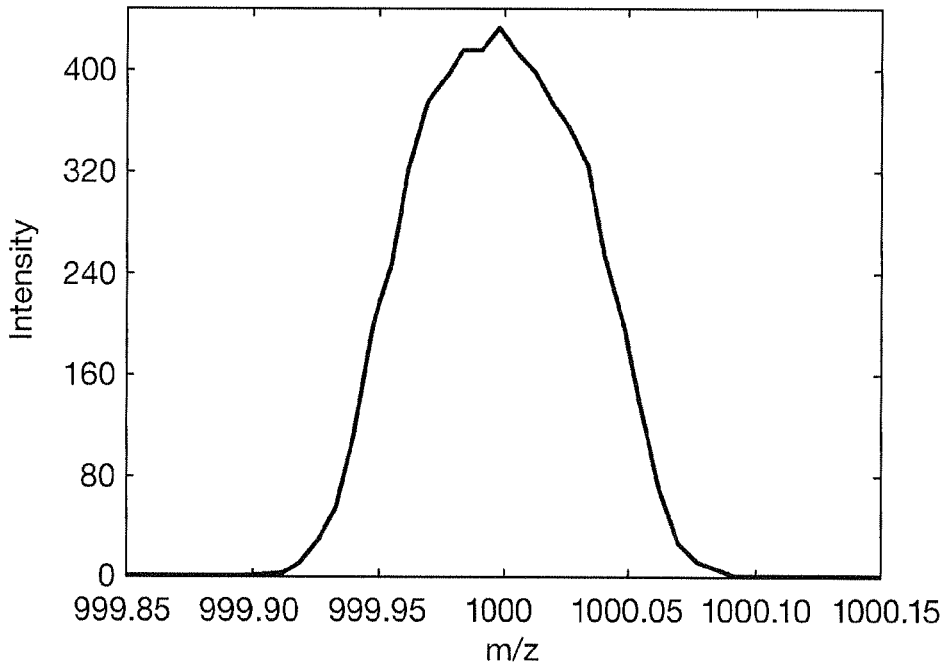
FIG. 9 shows a mass peak with a resolution of 11 k obtained when the detector is tilted by 0.2°.

If a tilt in the detector of 0.2° is introduced (i.e. tilting around the centre of the detector with the centre of the ion beam incident on the centre of the detector) then the resolution was observed to degrade to around 11 k as shown in FIG. 9.

Figure 10:
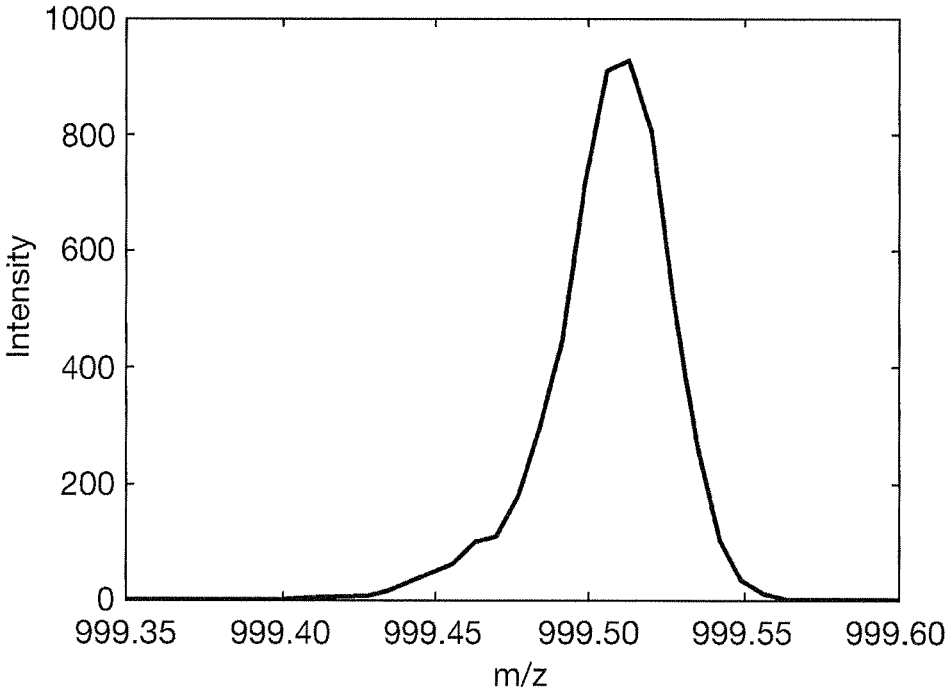
FIG. 10 shows a mass peak with a restored resolution of 27 k when a detector tilt of 0.2° is corrected for using a 2 kV gimbal in accordance with an embodiment of the present invention.

If an electrostatic gimbal correction is then applied according to an embodiment of the present invention then the performance can be restored. For example, a 5° tilted gimbal located 10 mm before the detector with 2 kV applied corrects for the spread in the ion arrival times and gives a resolution of about 21 k. If the system is resolved for P2 volts (to 9514 V) then resolution of about 27 k is restored as shown in FIG. 10. In this case the ion kinetic energy is being restored after the gimbal system according to the preferred embodiment and a short (e.g. 1 mm) region is provided with −2 kV across it to bring the ions back to their original time of flight volts energy.

With the gimbal just before the detector this kinetic energy correction is not required and a resolution of about 27 k is observed.

Figure 11:
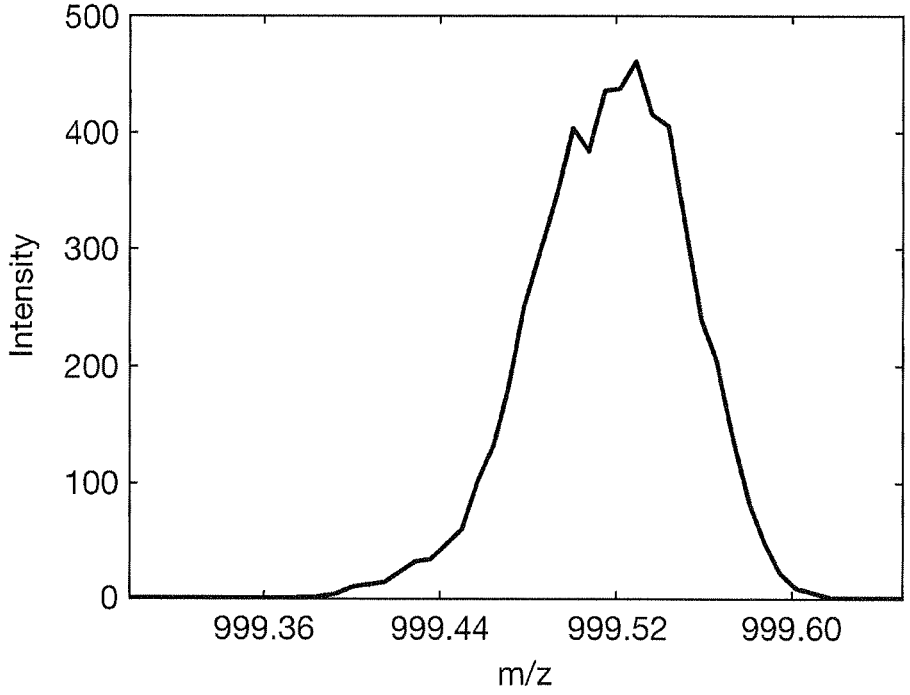
FIG. 11 shows a mass peak with a resolution of 11 k obtained when a 2 kV voltage is applied to the base system alone.

If 2 kV volts is applied to the base system alone (i.e. with no detector tilt) then the resolution degrades to 11 k as shown in FIG. 11 as might be expected since this effect matches the effect of the detector tilt it is set to compensate for.

Figure 12:
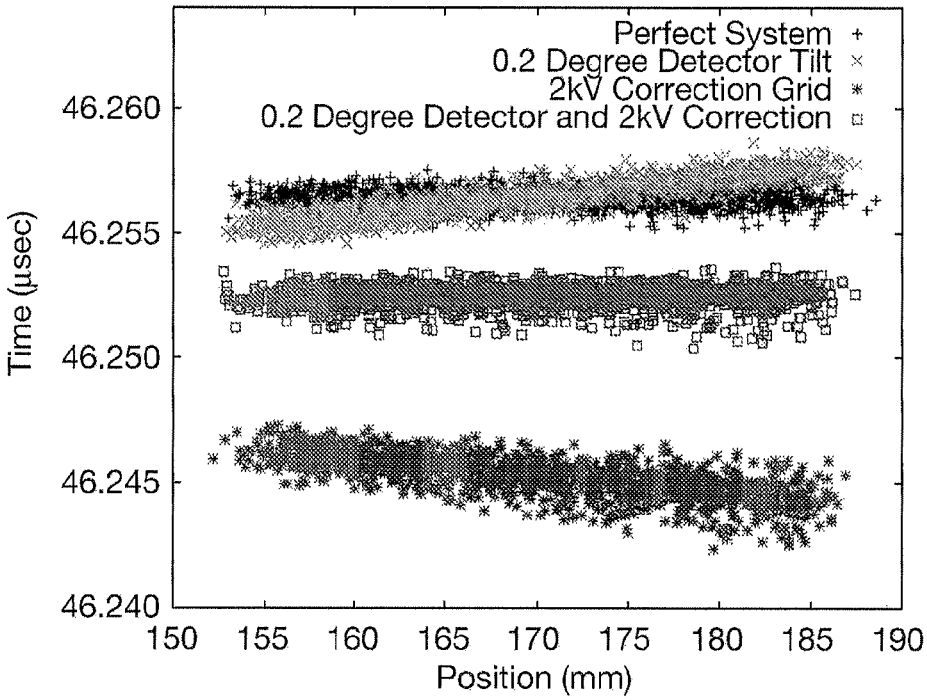
FIG. 12 shows the time of flight as a function of position across the detector for various systems.

FIG. 12 plots times of flight of ions as a function of position across the detector (centre at 170 mm) for the four cases discussed above. As expected, the perfect system is "flat" i.e. there is no time of flight dependence on position at the detector. Tilting the detector leads to a 1st order tilt in the time of flight-position plot, such that ions that strike to the right of the detector centre are shifted to longer flight times (consistent with the definition of the angle of tilt used). The correction voltage alone leads to the opposite tilt and a shift in absolute drift time, while the combination of the detector tilt and the gimbal correction leads to the cancellation of the tilts i.e. back to a flat time of flight-position plot (resolving for P2 volts hence the shift in absolute time of flight).

Figure 13:
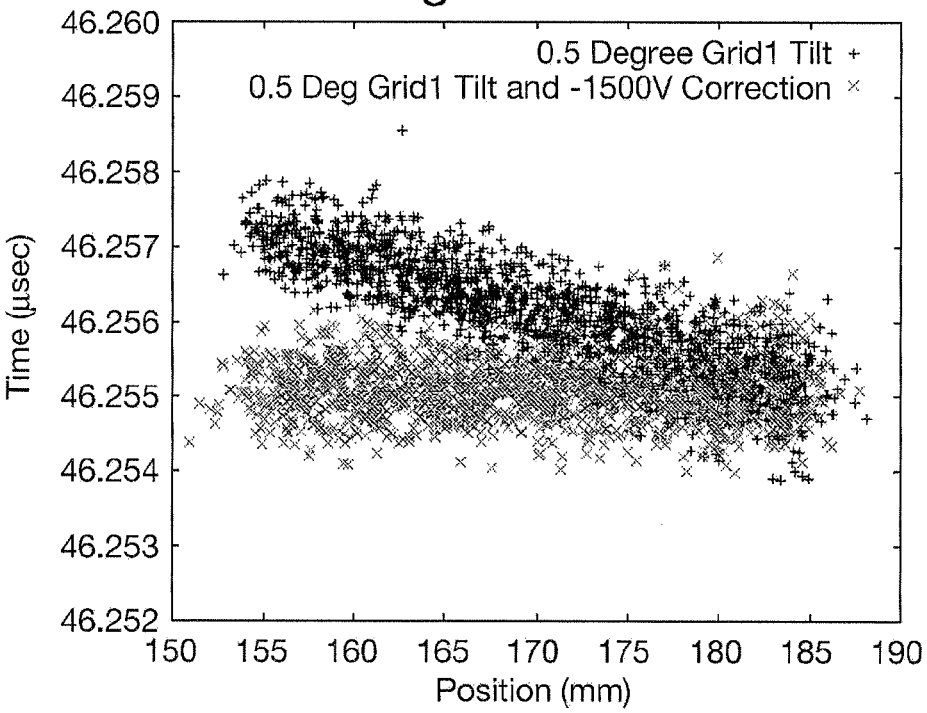
FIG. 13 shows the effect of a 0.5° tilt in grid electrode #1.

FIG. 13 shows the effect of a tilt of 0.5° in grid electrode #1. This produces the opposite tilt in the time of flight versus position plot, hence (for the same geometry of correction grid) a negative correction voltage is required. In this case −1500 V is applied and the tilt is compensated for. The resolution was again about 11 k with the tilt in grid electrode #1 and 26 k after correction according to the preferred embodiment.

The gimbal correction grid does not need to be positioned immediately before the detector. According to an embodiment the gimbal correction grid may be located just after grid electrode #1 (i.e. in the first field free region just after the pusher electrode and upstream of grid electrode #2).

Figure 14:
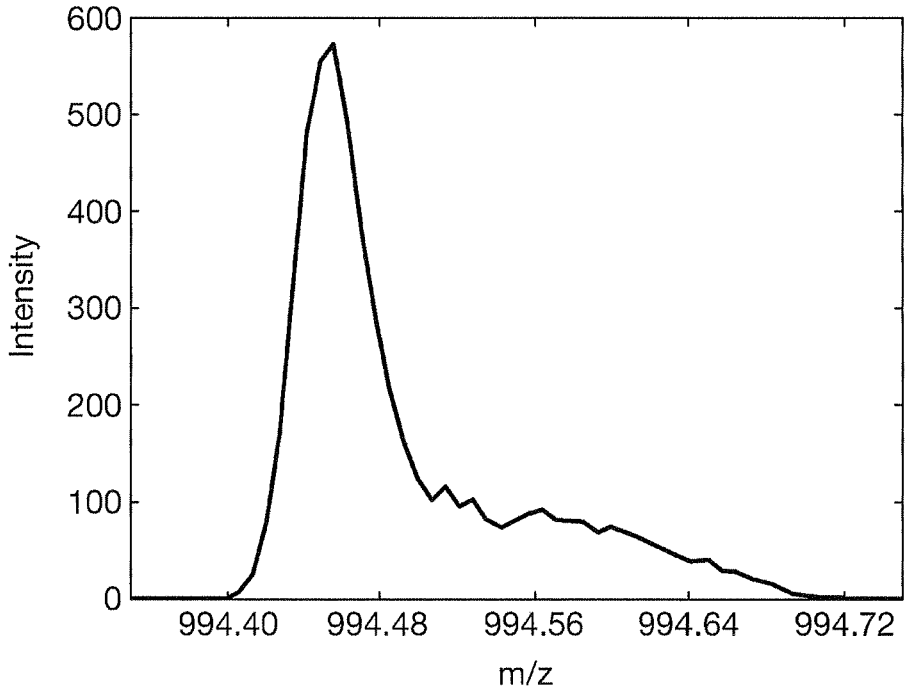
FIG. 14 shows the effect of a 2 kV gimbal after grid electrode #1 with a 0.2° detector tilt.

FIG. 14 shows the effect of a 2 kV gimbal located 10 mm after grid electrode #1 correcting for a 0.2° detector tilt. According to this embodiment the ion kinetic energy is not corrected after the gimbal system. As a result, an additional 2 kV of acceleration voltage is effectively applied to the ions (i.e. a three stage pusher). The resolution based on the FWHM is about 22 k although this does not account for the large high mass tail.

Figure 15:
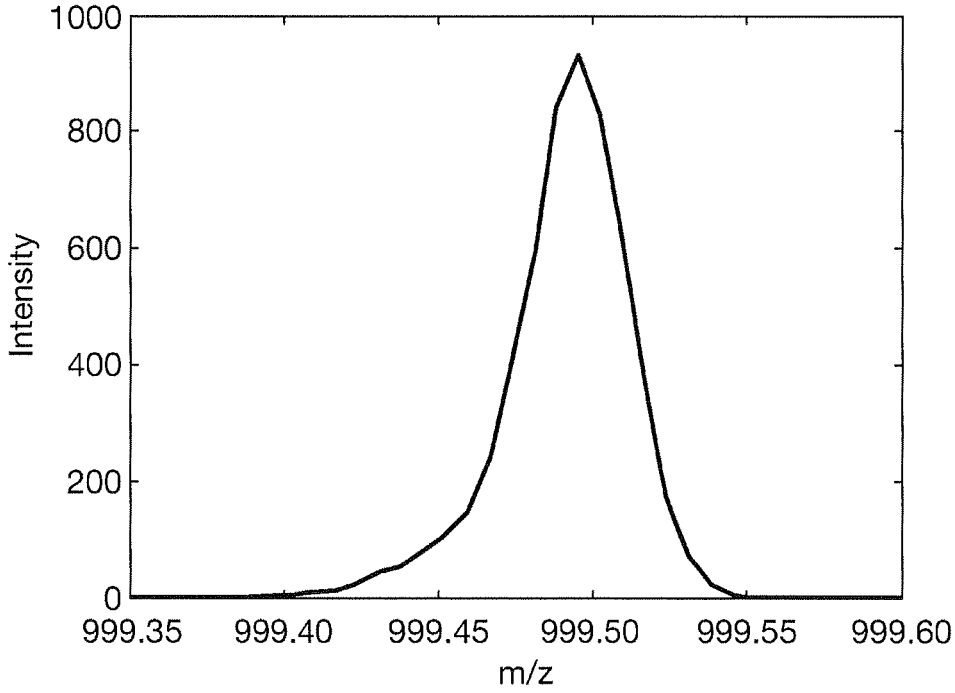
FIG. 15 shows the effect of 0.2° detector tilt, 2 kV correction after grid electrode #1 with ion kinetic energy restored.

FIG. 15 shows the same system but with the kinetic energy restored via a 1 mm 2 kV deceleration region after the gimbal. The resolution is about 26 k and no large high mass tail is observed. For gimbal positions other than immediately before the detector a deceleration region may be desirable, although tuning of multiple voltages may be sufficient to resolve the geometry (currently just resolving for P2 volts).

The application of a small linear field (in the time of flight direction) to the extraction region during the pre-extraction fill time can also be used to achieve a 1st order correction. In this case the pre-extraction velocity of an beam in the time of flight direction becomes linearly dependent on both the applied field and the distance travelled through the extraction region. This effect results in a linear dependence between position in the extraction region and the time of flight and can be arranged (by choice of field) to cancel out the detrimental effects of mechanical tilts and misalignments.

Although the present invention has been described with reference to the preferred embodiments, it will be understood by those skilled in the art that various changes in form and detail may be made without departing from the scope of the invention as set forth in the accompanying claims.

The invention claimed is:

1. A Time of Flight mass analyser comprising:

one or more devices arranged and adapted to correct for tilt in one or more isochronous planes of ions, wherein said one or more devices comprise one or more electrostatic devices for electrostatically correcting for said tilt;

wherein said one or more devices comprise a first acceleration stage or a first deceleration stage, wherein said first acceleration stage or said first deceleration stage is arranged and adapted to act upon an ion beam passing through said first acceleration stage or said first deceleration stage in a manner such that the time of flight or time of flight characteristics of ions in said ion beam are varied non-uniformly in a first transverse direction across said ion beam so as to correct for tilt in said first direction.

2. A Time of Flight mass analyser as claimed in claim 1, further comprising an ion detector.

3. A Time of Flight mass analyser as claimed in claim 2, wherein said one or more devices are arranged and adapted to correct for tilt in an isochronous plane of ions having a particular mass to charge ratio so that said isochronous plane is aligned so as to be substantially parallel to a plane of ion detection located upon a surface of or within said ion detector.

4. Time of Flight mass analyser as claimed in claim 3 wherein said isochronous plane comprises the plane of best fit of ions having a particular mass to charge ratio at a particular point in time.

5. A Time of Flight mass analyser as claimed in claim 1, wherein said Time of Flight mass analyser comprises an axial acceleration Time of Flight mass analyser.

6. A Time of Flight mass analyser as claimed in claim 1, wherein said Time of Flight mass analyser comprises an orthogonal acceleration Time of Flight mass analyser, and optionally comprises an orthogonal acceleration region, wherein optionally said orthogonal acceleration region comprises a pusher or puller electrode or a first grid or other electrode or a second grid or other electrode;

wherein said Time of Flight mass analyser optionally further comprises a first field free region between said pusher or puller electrode and said first grid or other electrode.

7. A Time of Flight mass analyser as claimed in claim 6 further comprising a second field free region between said first grid or other electrode and said second grid or other electrode.

8. A Time of Flight mass analyser as claimed in claim 6, further comprising a third field free region located either: (i) between said orthogonal acceleration region and said ion detector; or (ii) between said second grid or other electrode and said ion detector.

9. A Time of Flight mass analyser as claimed in claim 6 wherein:

said first acceleration stage or said first deceleration stage is located either:

(i) upstream of, downstream of or at intermediate position along said first field free region; (ii) upstream of, downstream of or at intermediate position along said second field free region; (iii) upstream of, downstream of or at intermediate position along said third field free region;

or (iv) upstream of, downstream of or at intermediate position along a field free region; or wherein said first acceleration stage or said first deceleration stage comprises a third grid or other electrode and a fourth grid or other electrode, wherein said third grid or other electrode is inclined at an angle $\alpha$ to said fourth grid or other electrode and wherein $\alpha \neq 0$.

10. A Time of Flight mass analyser as claimed in claim 6, further comprising a device arranged upstream of said orthogonal acceleration region and adapted to introduce a first order spatial focusing term in order to improve spatial focusing of a beam of ions.

11. A Time of Flight mass analyser as claimed in claim 6, further comprising a beam expander arranged upstream of said orthogonal acceleration region, said beam expander being arranged and adapted to reduce an initial spread of velocities of ions arriving at said orthogonal acceleration region.

12. A Time of Flight mass analyser as claimed in claim 1, wherein said tilt in said one or more isochronous planes results from misalignment of one or more ion-optical components.

13. A Time of Flight mass analyser as claimed in claim 1, further comprising one or more acceleration or deceleration stages arranged downstream of said one or more devices, wherein optionally said one or more acceleration or deceleration stages are arranged and adapted to alter the kinetic energy of said ions so that ions emerging from said one or more acceleration or deceleration stages have substantially the same kinetic energy as they had immediately prior to passing through said one or more devices.

14. A method of mass analysing ions comprising:

providing a Time of Flight mass analyser; and electrostatically correcting for tilt in one or more isochronous planes of ions by providing a first acceleration stage and or a first deceleration stage, wherein said first acceleration stage or said first deceleration stage act upon an ion beam passing through said first acceleration stage or said first deceleration stage in a manner such that the time of flight or time of flight characteristics of ions in said ion beam are varied non-uniformly in a first transverse direction across said ion beam so as to correct for tilt in said first direction.

* * * * *